US011371785B2

(12) United States Patent
Brown et al.

(10) Patent No.: US 11,371,785 B2
(45) Date of Patent: Jun. 28, 2022

(54) COOLING SYSTEM AND FABRICATION METHOD THEREOF

(71) Applicant: The Government of the United States of America, as represented by the Secretary of the Navy, Arlington, VA (US)

(72) Inventors: Robert F. Brown, Summerland Key, FL (US); Gregory M. Smith, Alexandria, VA (US); Christopher Brady, Bradenton, FL (US)

(73) Assignee: The Government of the United States of America, as represented by the Secretarv of the Navy, Washington, DC (US)

( * ) Notice: Subject to any disclaimer, the term of this patent is extended or adjusted under 35 U.S.C. 154(b) by 0 days.

(21) Appl. No.: 17/354,780

(22) Filed: Jun. 22, 2021

(65) Prior Publication Data

US 2022/0011057 A1 Jan. 13, 2022

Related U.S. Application Data

(60) Provisional application No. 63/050,184, filed on Jul. 10, 2020.

(51) Int. Cl.

| | |
|---|---|
| ***F28F 1/26*** | (2006.01) |
| ***B05B 15/00*** | (2018.01) |
| ***F41A 21/24*** | (2006.01) |

(52) U.S. Cl.

CPC ..... *F28F 1/26* (2013.01); *B05B 15/00* (2013.01); *F41A 21/24* (2013.01)

(58) Field of Classification Search

CPC .. F28F 1/26; F41A 21/24; F41A 13/10; F41A 13/12

USPC ..... 165/181

See application file for complete search history.

(56) References Cited

U.S. PATENT DOCUMENTS

| | | | | |
|---|---|---|---|---|
| 1,384,769 A * | 7/1921 | MacLaren | F41B 6/00 | 89/8 |
| 1,543,262 A * | 6/1925 | Methlin | F41A 13/12 | 89/37.03 |
| 2,126,792 A * | 8/1938 | MacGregor | F41A 13/12 | 89/14.1 |
| 2,181,927 A * | 12/1939 | Townsend | F28F 1/02 | 165/181 |

(Continued)

OTHER PUBLICATIONS

Written Opinion of the Internation Searching Authority dated Oct. 19, 2021 in corresponding International Application No. PCT/US2021/038509.

(Continued)

*Primary Examiner* — Jon T. Schermerhorn, Jr.
(74) *Attorney, Agent, or Firm* — US Naval Research Laboratory; Hong-Vinh Nguyen

(57) ABSTRACT

A cooling system for a cold spray nozzle or a thermal spray barrel and a fabrication method thereof are provided. The cooling system includes a sleeve with cooling fins that encapsulate a spray nozzle or barrel to enable heat transfer from the nozzle or barrel to the fins and then to the external ambient environment. The sleeve may optionally include one or more channels with cooling tubes to enable enhanced cooling with a cooling medium flowing through the tubes and across the fins.

13 Claims, 6 Drawing Sheets

(56) References Cited

U.S. PATENT DOCUMENTS 2,606,480 A * 8/1952 Selin ..... F41A 13/12 89/14.1
2,935,912 A * 5/1960 Hartley ..... F41A 13/12 42/76.02
2,981,155 A * 4/1961 Parlanti ..... F41A 21/20 42/78
3,727,513 A * 4/1973 Wicks ..... F41A 13/12 89/14.05
4,299,106 A * 11/1981 Hague ..... F28F 1/26 165/184
4,641,567 A * 2/1987 Creedon ..... F41A 13/12 89/8
4,753,154 A * 6/1988 Higashi ..... F41A 13/12 165/104.26
4,783,010 A * 11/1988 Kissel ..... C10J 3/50 241/3
6,178,769 B1 * 1/2001 Bartolles ..... F41A 13/04 62/419
6,508,159 B1 * 1/2003 Muirhead ..... F41A 21/24 89/14.05
7,464,496 B1 * 12/2008 Davies ..... F41A 21/24 42/75.02
7,735,408 B1 * 6/2010 Becker ..... F41A 21/24 102/374
7,793,577 B2 * 9/2010 Garwood ..... F41A 13/12 89/1.41
8,192,799 B2 6/2012 Kay et al.
10,641,569 B2 * 5/2020 Baker ..... F41A 21/24
10,987,645 B2 * 4/2021 Olberg ..... B01J 2/20
11,092,398 B2 * 8/2021 Slack ..... F41A 21/34
11,276,542 B2 * 3/2022 Greenland ..... F16C 37/002
2002/0033135 A1 3/2002 Kay et al.
2004/0191449 A1 9/2004 Haynes et al.
2008/0093065 A1 * 4/2008 Cheung ..... F28F 21/084 165/181
2010/0018673 A1 * 1/2010 Yang ..... F28F 7/02 165/104.19
2016/0356567 A1 * 12/2016 Bybee ..... F41C 23/16
2017/0217073 A1 * 8/2017 Fitzpatrick ..... B29C 45/23
2019/0154379 A1 * 5/2019 Baker ..... F41A 21/24
2019/0366361 A1 * 12/2019 Binek ..... B05B 7/1486
2020/0189046 A1 * 6/2020 Ravindranath ..... F28F 1/26
2021/0060584 A1 * 3/2021 Auffinger ..... B05B 9/047

OTHER PUBLICATIONS

International Search Report dated Oct. 19, 2021 in corresponding International Application No. PCT/US2021/038509.

* cited by examiner

COOLING SYSTEM AND FABRICATION METHOD THEREOF

CROSS-REFERENCE TO RELATED APPLICATIONS

This application claims the benefit of U.S. Provisional Patent Application No. 63/050,184 filed on Jul. 10, 2020, the entirety of which is incorporated herein by reference.

FEDERALLY-SPONSORED RESEARCH AND DEVELOPMENT

The United States Government has ownership rights in this invention. Licensing inquiries may be directed to Office of Technology Transfer, US Naval Research Laboratory, Code 1004, Washington, D.C. 20375, USA; +1.202.767.7230; techtran@nrl.navy.mil, referencing Navy Case Number 113071-US2.

BACKGROUND

Thermal spray and cold spray deposition are material deposition techniques that enable powdered feedstock material to be melted or heated, accelerated towards a target, and eventually deposited in layers to build a coating. Generally, the thermal spray process uses a combustion reaction or plasma generation event to produce gas pressure and temperature, while the cold spray process uses pressurized feed gas, via storage bottles or tank, with an in-line gas heater. In either process, hot gasses are forced through a nozzle or barrel to accelerate deposition gas and feedstock particles. However, this increases the propensity for accelerated particles to adhere or adsorb onto the nozzle/barrel internal wall. This is typically an issue for softer, metallic materials, such as aluminum, copper, etc., when application temperatures are high (intrinsic for thermal spray), and becoming more widespread with higher operating temperatures used for cold spray.

In a thermal spray process, such as high velocity oxygen fuel (HVOF) spraying, control of deposition equipment hardware, temperatures are typically handled by a closed-loop liquid cooling system with the media flowing around the cooling jacket that surrounds the HVOF barrel. The cooling media absorbs heat generated on the outer surface of the HVOF barrel and is discharged from the cooling jacket to an external heat exchanger where the media is cooled and cycled through the closed loop system again. With cold spray, this has been adapted to some degree, but full liquid cooling is generally viewed as unnecessary as particle temperatures are lower in comparison to thermal spray. However, with the overall cold spray technology shifting towards higher operating temperatures, particle buildup or entrapment within the nozzle may occur and warrants a practical cooling process.

SUMMARY

This Summary is intended to introduce, in simplified form, a selection of concepts that are further described in the Detailed Description. This Summary is not intended to identify key or essential features of the claimed subject matter, nor is it intended to be used as an aid in determining the scope of the claimed subject matter. Instead, it is merely presented as a brief overview of the subject matter described and claimed herein.

Embodiments described herein are directed to a cooling system for a cold spray nozzle or thermal spray barrel and a fabrication method thereof. The cooling system includes a sleeve with cooling fins that encapsulate a nozzle or barrel to enable heat transfer from the nozzle or barrel to the fins and then to the external ambient environment. The sleeve may optionally include one or more channels with cooling tubes to enable enhanced cooling with a cooling medium flowing through the tubes and across the fins. Thus, the cooling fins may provide radiative cooling while the channels and tubes enable forced convection cooling with the cooling medium.

An embodiment is directed to a cooling system for a nozzle or a barrel. The system includes a sleeve having a central bore, the sleeve being configured to be in close contact with the nozzle or the barrel to enable heat transfer between the nozzle or the barrel and the sleeve. A plurality of fins are disposed along a length of the sleeve with a spacing between each of the fins, the fins extending radially from the central bore and enabling radiative dissipation of heat from the nozzle or barrel. A channel is formed along the length of the sleeve, the channel having a channel opening at a first end of the sleeve. A tube is configured to be placed into the channel via the opening. An inlet is formed on the first end of the sleeve, the inlet being configured to allow a cooling medium to be injected into the tube.

Another embodiment is directed to a method for fabricating a cooling system for a nozzle or a barrel. The method includes forming a sleeve having a central bore. The sleeve is configured to be in close contact with the nozzle or the barrel to enable heat transfer between the nozzle or the barrel and the sleeve. The method further includes arranging a plurality of fins along a length of a sleeve with a spacing between each of the fins, the fins extending radially from the central bore and enabling radiative dissipation of heat from the nozzle or the barrel. The method also includes forming a channel along the length of the sleeve, the channel having a channel opening at a first end of the sleeve, and forming a tube to be placed into the channel opening. The method further includes forming an inlet on the first end of the sleeve, the inlet being configured to allow a cooling medium to be injected into the tube.

A further embodiment is directed to another cooling system for a nozzle or a barrel. The cooling system includes a sleeve having a central bore, the sleeve being configured to be in close contact with the nozzle or the barrel to enable heat transfer between the nozzle or the barrel and the sleeve, the sleeve further being configured for a thermal spray process or a cold spray process. The system further includes a plurality of fins disposed along a length of the sleeve with a spacing between each of the fins, the fins extending radially from the central bore and enabling radiative dissipation of heat from the nozzle or the barrel.

DETAILED DESCRIPTION

Definitions

Figure 2:
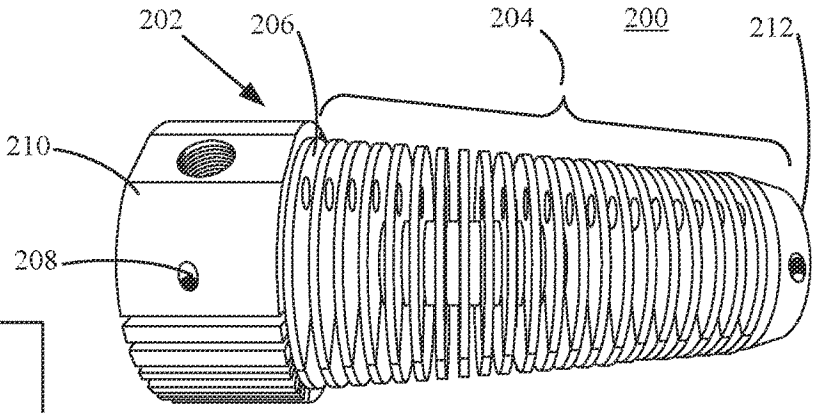
FIG. 2 depicts an orthogonal view of a cooling system for a nozzle or barrel, according to an example embodiment.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, it is submitted that it is within the knowledge of one skilled in the art to effect such feature, structure, or characteristic in connection with other embodiments whether or not explicitly described.

In describing and claiming the disclosed embodiments, the following terminology will be used in accordance with the definition set forth below.

As used herein, the singular forms "a," "an," "the," and "said" do not preclude plural referents, unless the content clearly dictates otherwise.

As used herein, the term "and/or" includes any and all combinations of one or more of the associated listed items.

As used herein, the term "about" or "approximately" when used in conjunction with a stated numerical value or range denotes somewhat more or somewhat less than the stated value or range, to within a range of ±10% of that stated.

Terminology used herein should not be construed as being "means-plus-function" language unless the term "means" is expressly used in association therewith.

Generally, the term "barrel" is associated with a thermal spray process, whereas "nozzle" is associated with a cold spray process and efforts have been made to maintain this distinction. However, as described herein, the terms "nozzle" and "barrel" may be used interchangeably for either the thermal spray process or cold spray process.

Overview

With both cold spray and thermal spray deposition processes, to produce a spray coating with an acceptable quality, the nozzle/barrel must be very clean, without perturbation. However, with both of these processes, the temperature of the nozzle/barrel may become elevated due to the flow of heated gas and feedstock material through the nozzle or barrel. As the nozzle/barrel increases in temperature, there is a propensity for the feedstock material flowing through the nozzle/barrel to stick to the inner diameter walls, especially as the temperatures of the nozzle/barrel walls increase.

Fine, metallic powders, especially when deposited at higher temperatures (which may be necessary with harder substrates and/or lower specific heat nitrogen processing gas) can lead to nozzle/barrel clogging. Higher primary carrier gas temperatures result in nozzle/barrel hardware temperature increase, subsequently increasing potential for particle buildup and eventual internal clogging. Smaller particles tend to absorb heat faster than the larger particles, making them prone to sticking to the hot nozzle/barrel inner wall. Narrowing the particle size distribution range may help to extend the nozzle/barrel service life, but is generally inadequate due to nozzle (or barrel) expense.

To mitigate the above issues, the cooling system described herein provides hardware temperature reduction, particularly by lowering the temperature of the nozzle or barrel used for cold spray or thermal spray, respectively. Thus, the cooling system described herein may achieve certain advantages over having no cooling system or having the traditional unwieldy liquid cooling system. The cooling system is relatively low-cost and convenient to use as it may be configured to encapsulate an existing spray nozzle/barrel. In some embodiments, the cooling system does not require the traditional liquid pumps and storage. In other embodiments, the liquid pumps and storage requirement may be reduced as compared to the liquid pumps and storage requirement of the traditional liquid cooling systems. This supports portable use of the cold/thermal spray system, making it lightweight and easy to handle without interferences or obstructions. Such portable application may be useful where liquid cooling may not be available, yet high deposition temperatures are required. Moreover, the lowered temperature of the nozzle/barrel reduces the tendency for feedstock particles to stick to the inner wall of the nozzle/barrel, thus the service life of the nozzle/barrel may be extended. Additionally, the cooling system describes herein allows for tighter control of the deposition process or parameters (e.g., time, temperature, etc.) and thus the range of operation of the spray system may be extended. For example, the window of deposition may increase as the cooling system enables the deposition process to take place at a larger range of temperatures. Additionally, wider range of material and/or particle state may be utilized with embodiments of the cooling system described herein.

Example Embodiments

Figure 1:
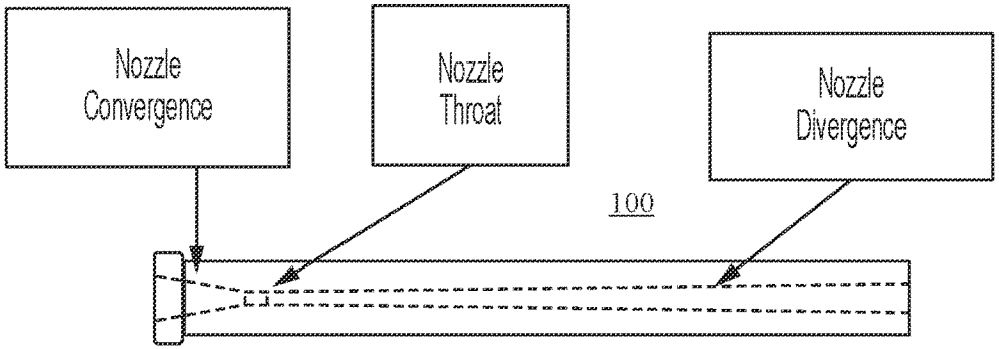
FIG. 1 depicts a section view of a nozzle or barrel that may be utilized with example embodiments of the cooling system described herein.

FIG. 1 depicts a section view of a nozzle/barrel 100 that may be utilized with example embodiments of the cooling system described herein, and may be utilized with either a cold spray or a thermal spray process. While FIG. 1 depicts nozzle/barrel 100 as a de Laval one, other nozzle/barrel designs may be utilized with example embodiments. As shown in FIG. 1, nozzle/barrel 100 includes different sections, a convergence section, a throat or constriction section, and a divergence section. FIG. 1 provides some example values for illustrative purposes, but they are not intended to be so limited.

Cold spray is a solid-state powder deposition technique that involves accelerating powder feedstock particles, typically 10-100 μm in size, through a converging/diverging nozzle with a compressible carrier gas, such as helium, nitrogen, or air, to achieve supersonic gas velocities for favorable deposition. Such a nozzle may be a de Laval nozzle (e.g., as shown in FIG. 1), which is a tube that has an internal asymmetric internal hourglass shape designed to convert potential (and heat) energy of the feed gas into kinetic energy.

In a cold spray operation utilizing a nozzle (e.g., nozzle/barrel 100 of FIG. 1), a carrier gas enters the convergence section of the nozzle and the gas is compressed at subsonic velocity through the length of the nozzle until it reaches the constriction section or throat. The particle velocity is relatively slow at this location, compared to the gas velocity, and the particles continue to absorb heat from the carrier gas. As the gas exits the throat and enters the diverging section of the nozzle, pressure and temperature reduce, while velocities increases to near or supersonic velocities. Particles accelerate in the gas stream from the end of the throat to the nozzle exit, where compressible gas velocities, $V_g$, follow equation 1:

$$V_g = M\sqrt{\gamma RT} \quad \text{(equation 1)}$$

where R is the specific gas constant, T is the temperature, γ is the specific heat ratio (e.g., 1.4 for diatomic nitrogen, and 1.66 for monatomic helium), and M is the Mach number. Gas velocities may also be influenced by aspects of the nozzle throat as follows.

$$\frac{A}{A^*} = \frac{1}{M}\left(\left[\frac{2}{\gamma+1}\right]\left[1+\left(\frac{\gamma-1}{2}\right)M^2\right]\right)^{(\gamma+1)/[2(\gamma-1)]} \quad \text{(equation 2)}$$

where A is the calculated cross-sectional area along the nozzle, and A* is the area of the nozzle throat. Employing gas stream velocities, pressures, and temperatures, the particle velocity ($V_p$) may be modeled based on the estimated particle drag coefficient ($C_d$), mass of the particle (m), gas velocity ($V_g$), cross sectional area of a particle ($A_p$), and the assumption that the particle velocity is much less than the gas velocity, as follows.

$$V_p = V_g\sqrt{\frac{C_d A_p \rho_g}{m}} \quad \text{(equation 3)}$$

where $\rho_g$ is the gas density. Particle drag is dependent on particle density, size and shape, where the larger or the more irregular the shape, drag increases and particle velocity or kinetic energy decreases. This aspect is important, especially when carrier gas temperatures and pressures are low, such as for portable cold spray systems. Additionally, the particle temperature is subsequently lower than its melting point upon exit from the nozzle. This is a desirable aspect of cold spray, where the feedstock properties are retained during deposition and particle exit velocities can range from 500-1200 m/s. The basis of particle velocity and momentum create the relatively high kinetic energy, coupled with the cold spray fluid mechanics, which is the driving force for the critical velocity window of deposition, determine coating adhesion, cohesion, and deposit compaction and efficiency. The solid-state particle undergoes deformation and adiabatic shear instability as it impacts and craters into the substrate, which consequently results in substrate deformation, improving first layer adhesion.

High-pressure cold spray and low-pressure cold spray are two types of cold spray processes. High-pressure cold spray uses nitrogen, helium, or air as a carrier gas, generally at pressures of 1 MPa or greater and/or flow rates greater than 2 $m^3$/min. Low-pressure cold spray uses the similar carrier gases as high-pressure cold spray, but at lower pressures (e.g., below 1 MPa) and/or lower flow rates (e.g., below 2 $m^3$/min).

Feedstock materials for cold spray include pure metals (e.g., aluminum, nickel, copper, or titanium), metal alloys, polymers, and hybrid materials (e.g., metal-metal, metal-alloy, metal-ceramic, or metal-graphene/carbon nanotubes). These materials allow for the application of different coatings, for example, to repair a component with similar or improved materials or to form desired features into the cold spray coatings deposited on a substrate or a target surface of the component. Modifying or repairing a component may be a more economical choice than replacing that component. The cold spray process may be a useful alternative for brush plating, electroplating, weld repairs, etc., because it is a quick process and can build material reliably in a relatively short time.

The advantages of cold spray include materials being deposited at lower temperatures than their melting points and no melting in the process, e.g. deposition in solid-state, limiting particle or substrate thermal distortion or oxidation. Because of the focused particle spray path, there is little preparation that is required of the substrate area (e.g., minimal masking of the area, no heat-affected zone). The waste materials (non-deposited powders) may be recycled, while repairing of parts saves energy, time to procure new parts, and resources. In addition, portable cold spray system and/or equipment allows cold spray to be used for parts where removal for repair is otherwise difficult or not feasible.

Thermal spray is another coating deposition process that may utilize a barrel (e.g., nozzle/barrel 100 of FIG. 1). The difference between thermal spray and cold spray is that thermal spray generally comprises of molten or semi-molten droplets of feedstock material that are then sprayed onto a substrate. Thermal spray covers a wide range of sub-processes, which vary by mode of deposition, types of materials, and in application. Generally either powder or wire feedstock materials are used and may be chemically or electrically heated to promote softening or melting of the feedstock prior to deposition. Feedstock material for thermal spray includes metals, refractory materials, ceramics, cermets, composites, and polymers, essentially anything that melts or softens during the heating process, with a large degree of process control, depending on the process and material selection.

Several types of thermal spray exist, including air plasma spray (APS), wire arc, flame or high velocity oxygen fuel (HVOF) spray. The plasma spraying process uses an electric arc to form a high-temperature, thermal plasma jet through dissociating and ionizing the argon and supplementary hydrogen or helium process gases, to subsequently heat and melt the feedstock material. Plasma temperatures in the immediate vicinity of the arc can be greater than 10,000 K. The feedstock material is then fed into the thermal plasma by an inert gas of nitrogen or similar, and propelled towards a target surface. The electric arc or twin-wire arc spraying processes also use electrical means to heat the coating material via a direct electrical arc between one or two feedstock wire material sources to cause them to melt. Compressed air or inert gas may atomize melt product and propel the molten droplets towards the substrate to form a coating. The flame spraying process uses a combustion chemical means of heating. A fuel source, such as diesel, propane or acetylene, is combusted with oxygen, to heat the feedstock material in wire or powder form. Combustion product, compressed air, or inert gas then propels the molten product towards the substrate to form a coating. The HVOF thermal spray also uses a combustion heating process, in which liquid or gas fuel is mixed with oxygen or compressed air. The feedstock particles are in a combustion chamber or are introduced into the gas stream, which flows through the barrel, forcing the exhaust gases and feedstock particles out at supersonic speeds towards the substrate. The HVOF process is notable because of the high deposition velocities, which can be 400 m/s and above, in line with cold spray deposition. Whereas other thermal spray processes can induce a degree of particle oxidation during the period between heating and impact on a target substrate, HVOF process can reduce the propensity for oxidation due to the small particle dwell times and rapid deposition times.

FIG. 2 depicts an orthogonal view of a cooling system 200 for a nozzle or barrel, according to an example embodiment. System 200 may passively cool a nozzle/barrel of a thermal spray or cold spray process, respectively, to reduce the temperature, thereby mitigating particle sticking/clogging issues. As shown in FIG. 2, system 200 includes a sleeve 202 having a central bore (not shown in FIG. 2), an inlet end 210 and an outlet end 212. Sleeve 202 may include cooling fins 204 disposed along the length of sleeve 202 with a spacing (e.g., spacing 206) between each of the fins. Fins 204 extend radially from the central bore to enable radiative dissipation of heat from the nozzle. Thus, fins 204 may have high surface areas and low aspect ratio to facilitate heat dissipation. Sleeve 202 is configured to encapsulate a standard nozzle/barrel (e.g., nozzle/barrel 100 of FIG. 1), in its entirety or a part thereof, and to be in close contact with the nozzle/barrel to enable heat transfer between the nozzle/barrel and sleeve 202. Inlet end 210 and outlet end 212 of sleeve 202 may respectively correspond to an inlet end and outlet end of the nozzle/barrel. Sleeve 202 may be attached around the nozzle/barrel in a close or tight fitting manner and/or may include several sections (e.g., halves) that may be secured together via a suitable removable securing means, such as a screw inserted into a threaded bore 208 shown in FIG. 2. Other securing means may also be utilized, for example, one or more of a fastener, a strap wrapped around the sleeve with a locking mechanism, a hinge, latch, clasp, etc. Thus, sleeve 202 may easily be placed on or removed from the nozzle.

Figure 3:
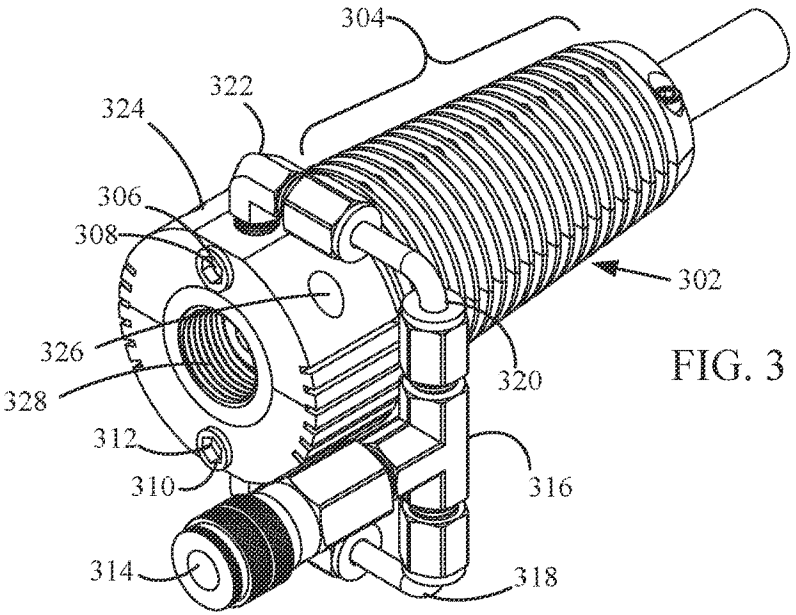
FIG. 3 depicts a perspective view of a cooling system for a nozzle or barrel, according to an example embodiment.

In some applications, when enhanced cooling of the nozzle/barrel is desired, a cooling medium may be fed through the cooling fins to cool the nozzle/barrel via conduction and forced convection in addition to the radiative cooling provided by the fins. FIG. 3 depicts a perspective view of a cooling system 300 for a nozzle or barrel, according to an embodiment. Similar to system 200, system 300 includes a sleeve 302, cooling fins 304 extending from a central bore 328 of sleeve 302. Sleeve 302 may further include a channel 306 with a channel opening 308, and a channel 310 with a channel opening 312. Channel opening 308 and channel opening 312 may be at the inlet end of sleeve 302. In an embodiment, channels 306 and 310 may be closed at the outlet end of sleeve 302. Cooling tubes with perforations may be placed into channel 306 and channel 310 via channel opening 308 and channel opening 312, respectively. System 300 may further include a fitting 314 that is coupled with a tee fitting 316, which is connected to a jumper tube 318 and a jumper tube 320. Each jumper tube may be connected to a fitting, such as a fitting 322 shown in FIG. 3. Fitting 322 may be placed into an inlet on a collar 324 of sleeve 302.

Sleeve 302 may be attached around a nozzle/barrel in a close or tight fitting manner. In embodiments, a conductive paste or similar may be utilized to ensure tight fitting and/or to enhance conductivity between the nozzle/barrel and sleeve 302. Sleeve 302 may also include several sections (e.g., halves) secured together via a suitable removable securing means, such as a screw inserted into a threaded bore 326 shown in FIG. 3. Other securing means may also be utilized, for example, one or more of a fastener, a metal strap wrapped around the sleeve with a locking mechanism, a hinge, a latch, a clasp, etc. Thus, sleeve 302 may easily be placed on or removed from the nozzle/barrel.

In operation, a cooling medium may be injected into system 300 via a hose that is configured to be coupled with fitting 314 to provide forced convection cooling. Non-limiting examples of the cooling medium include compressed air (e.g., low-pressure air), a noncombustible gas (e.g., nitrogen, oxygen, helium, and argon), a liquid, or a combination thereof. The cooling medium may flow through the cooling tubes inside channels 306 and 310 and across each of fins 304. Thus, fins 304 may provide radiative cooling and channels 306 and 310 along with the inserted tubes enable forced convection cooling with the cooling medium flowing across fins 304, the combination of which reduces the temperature of the encapsulated nozzle/barrel and mitigate deposition particle clogging or attachment.

In embodiments, more or fewer components may be included in systems 200 and 300. For example, more channels and associated fittings/tubes may be included. The number of fins may vary, depending on the application and/or equipment (e.g., nozzle/barrel length). The shapes and sizes of the components may be different than shown in the figures. Systems 200 and 300 and components thereof may be made of high conductivity material(s), such as aluminum, copper, steel, etc. For example, the sleeve and fins may be made of aluminum or copper and securing means or fittings may be made of steel. Systems 200 and 300 may be implemented in various ways. For example, FIGS. 4-8 depict different views that show the different implementations and/or system components in further detail.

Figure 4:
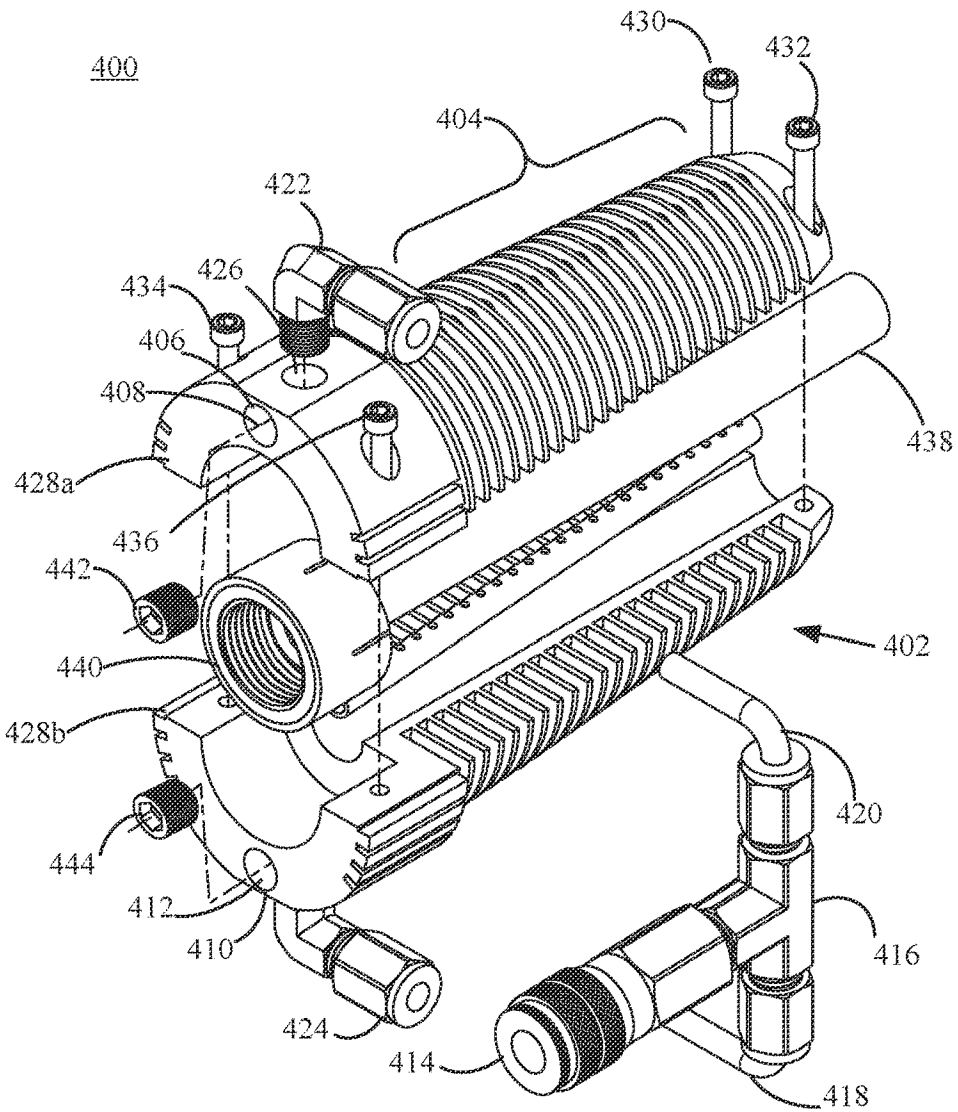
FIG. 4 depicts an exploded view of a cooling system for a nozzle or barrel, according to an example embodiment.

FIG. 4 depicts an exploded view of a cooling system 400 for a nozzle or barrel, according to an example embodiment. System 400 includes a sleeve 402, cooling fins 404, a channel 406 with a channel opening 408, and a channel 410 with a channel opening 412. Channel opening 408 and channel opening 412 may be at the inlet end of sleeve 402. System 400 may further include a fitting 414 that is coupled with a tee fitting 416, which is connected to jumper tube 418 and jumper tube 420. Jumper tube 418 may be connected to a fitting 424 and jumper tube 420 may be connected to a fitting 422. Fitting 422 is configured to be placed into an inlet 426 on sleeve 402, and fitting 424 is configured to be placed into another inlet on sleeve 402. Inlet 426 may be formed on the inlet end of sleeve 402, the end where the nozzle or barrel is respectively coupled to the cold spray or thermal spray system.

In example embodiments, sleeve 402 may be formed as one part. In other embodiments, sleeve 402 may include several sections. For example as shown in FIG. 4, sleeve 402 includes two halves that may be secured together by a suitable removable securing means, such as via screws 430 and 432 on the outlet end of sleeve 402 and via screws 434 and 436 on the inlet end of sleeve 402. Other securing means may additionally or alternately be utilized, for example, a fastener, a metal strap wrapped around sleeve 402 with a locking mechanism, a hinge, a latch, a claps, etc. Thus, sleeve 402 may easily be placed on or removed from a nozzle/barrel 438.

When forced convection cooling is desired, a cooling medium may be injected into system 400 via a hose that may be coupled with fitting 414. The cooling medium may flow through the fittings and jumper tubes into sleeve 402 via cooling tubes inserted into channels 406 and 410 via channel openings 408 and 412, respectively. A plug 442 and a plug 444 may be inserted into channel openings 408 and 412, respectively, to secure the cooling tubes and seal the channel openings prior to operation of system 400. In this manner, the cooling medium may flow through the tubes and across fins 404 to provide the forced convection cooling. The cooling medium may be a single cooling agent or may be a combination of cooling agents, such as compressed air, or a pressurized gas, or water to enable flow through fins 404 in a mist form. In embodiments, the cooling medium may be supplied from the same gas supply as the cold spray or thermal spray system (e.g., unheated process gas such as nitrogen, argon or helium). In other embodiments, the cooling medium supply for system 400 may be separate from the gas supply of the cold spray or thermal spray system.

In FIG. 4, nozzle/barrel 438 includes a retaining nut 440 to enable nozzle/barrel 438 to be connected to a cold spray or thermal spray system. As shown in FIG. 4, sleeve 402 includes a collar, formed of portions 428*a* and 428*b*, designed to wrap around retaining nut 440. However, in other embodiments, sleeve 402 may be configured to cover nozzle/barrel 438 in a different manner. For example, sleeve 402 may be configured to cover nozzle/barrel 438 but not cover retaining nut 440.

Figure 5:
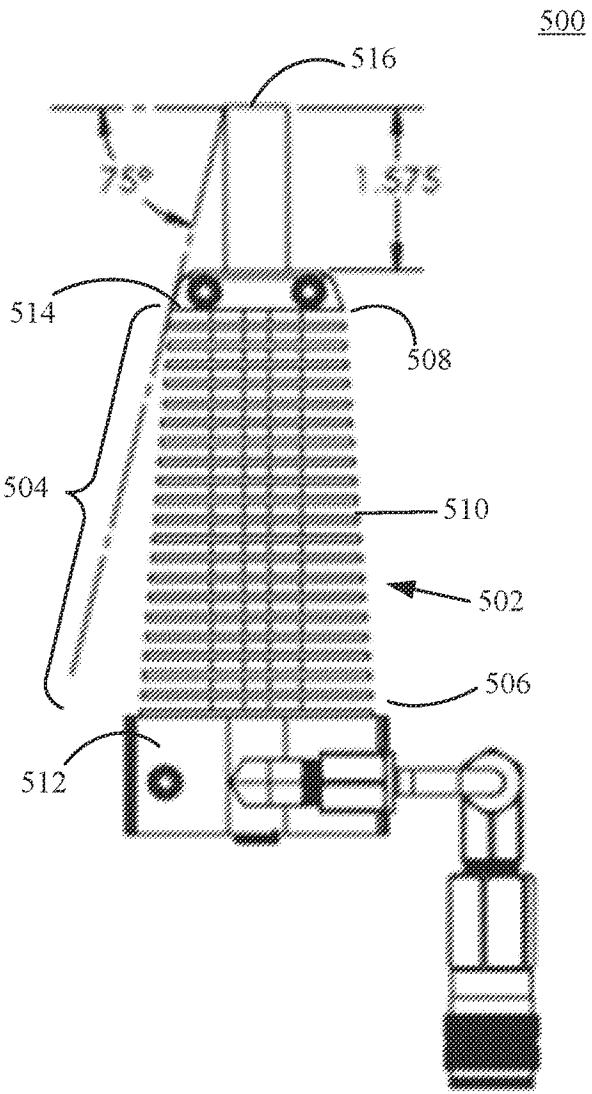
FIG. 5 depicts a top view of a cooling system for a nozzle or barrel, according to an example embodiment.

In embodiments, the cooling system may be optimized for a particular application and/or nozzle/barrel shape and size. FIG. 5 depicts a top view of a cooling system 500, according to an example embodiment. In FIG. 5, system 500 includes sleeve 502 that has cooling fins 504 extending radially from a central bore. Sleeve 502 may include an inlet end 512 and an outlet end 514 that respectively correspond to the inlet end and outlet end of a nozzle/barrel 516. In an embodiment, sleeve 502 may be configured to encapsulate a major portion of nozzle/barrel 516. For example, as shown in FIG. 5, the tip (e.g., 1.575 inches) of nozzle/barrel 516 may be exposed and not encapsulated by sleeve 502. In other embodiments, sleeve 502 may have other configurations. For example, sleeve 502 may be configured to cover the entirety of nozzle/barrel 516 or cover the tip of nozzle/barrel 516 but not the retaining nut, etc.

In embodiments, each of fins 504 may be annular or a ring-shaped object. Each fin is defined by two radii, the first being the radius of a central bore of sleeve 502 and the second being the radius of the outer ring of the fin. Alternatively, each fin may be defined by its diameter. In embodiments, the diameter of each fin may be uniform. In other embodiments, fins 504 may have varying diameters, with a first fin 506 at the inlet end of sleeve 502 having a largest diameter, and a last fin 508 at the outlet end of sleeve 502 having the smallest diameter (e.g., last fin 508 may have an outer radius that is 15 degrees from the center axis of the bore). This is because there is more heat that needs to be dissipated at the inlet end as opposed to the outlet end of sleeve 502. In embodiments, the spacing between each fin, such as spacing 510, may be the same throughout sleeve 502 or it may vary. As sleeve 502 and fins 504 may be configured in various ways to accommodate different nozzles/barrels/systems, the specific values (i.e., clearance dimensions), as well as the shape, size, thickness, number of fins and spacing, etc., shown in FIG. 5 are not intended to be limiting.

Figure 6:
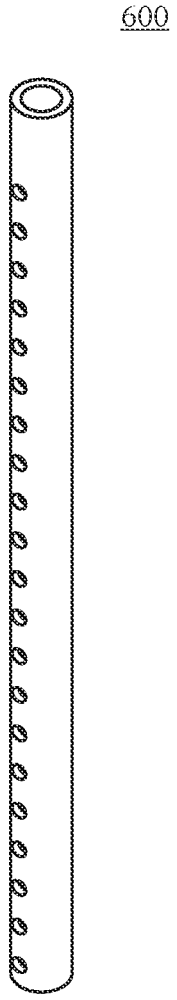
FIG. 6 depicts a perspective view of a cooling tube, according to an example embodiment.
Figure 7:
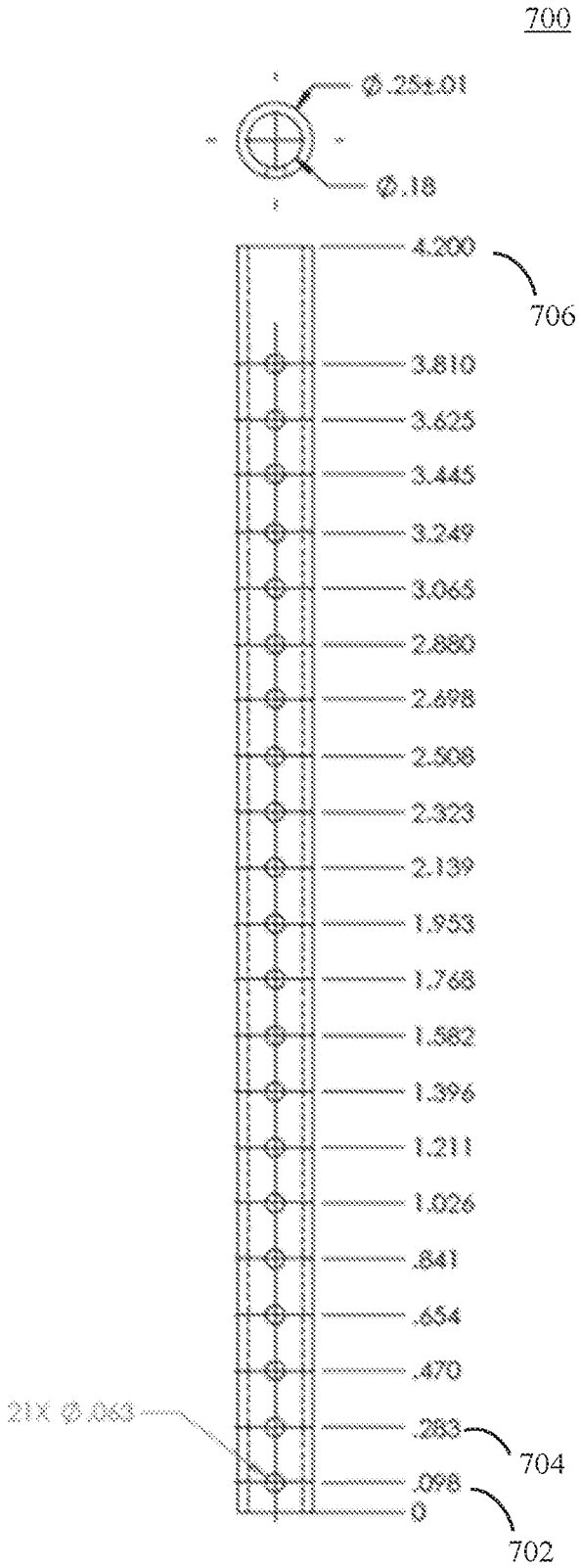
FIG. 7 depicts a side view of a cooling tube, according to an example embodiment.

As previously mentioned, cooling tubes may be used in the cooling system described herein. FIG. 6 depicts a perspective view of a cooling tube 600, according to an example embodiment. Cooling tube 600 includes a plurality of perforations throughout its length. Cooling tube 600 may have open ends. Cooling tube 600 may be configured in many ways. For example, FIG. 7 depicts a side view of a cooling tube 700, according to an example embodiment. In FIG. 7, cooling tube 700 includes a plurality of perforations along the length of cooling tube 700, each of the perforations being configured to be aligned with the spacing between each of the fins (e.g., fins 504 of FIG. 5) to enable the cooling medium to flow across the fins. For example, as shown in FIG. 7, 21 perforations are arranged along the 4.2-inch-length of cooling tube 700, each perforation having a diameter of 0.063 inch. A first perforation 702 may be placed/centered at 0.098 inch from one end of cooling tube 700. A second perforation 704 may be placed/centered at 0.283 inch, and so on until a last perforation 706 that may be placed/centered at 3.810 inches from the end of cooling tube 700. Thus, cooling tube 700 may be used with a sleeve that has cooling fins with a spacing of 0.063 inch or larger between each fin to accommodate the perforations of cooling tube 700. In this manner, cooling tube 700 may direct the cooling medium onto the cooling fins to cool them via forced convection.

In embodiments, the perforations of cooling tube 700 may be uniform in shape, size, spacing, etc. In other embodiments, these characteristics may vary. For example, the perforations may be graduated in size from the smallest size at the inlet end to the largest size at the outlet end (at the tip of the nozzle/barrel) on cooling tube 700. In operation, the nozzle/barrel is generally cooler at the outlet end and the pressure of the cooling medium is the weakest at this point, and the graduated perforations may account for the cooler temperature and reduction of pressure at the tip of the nozzle.

Figure 8:
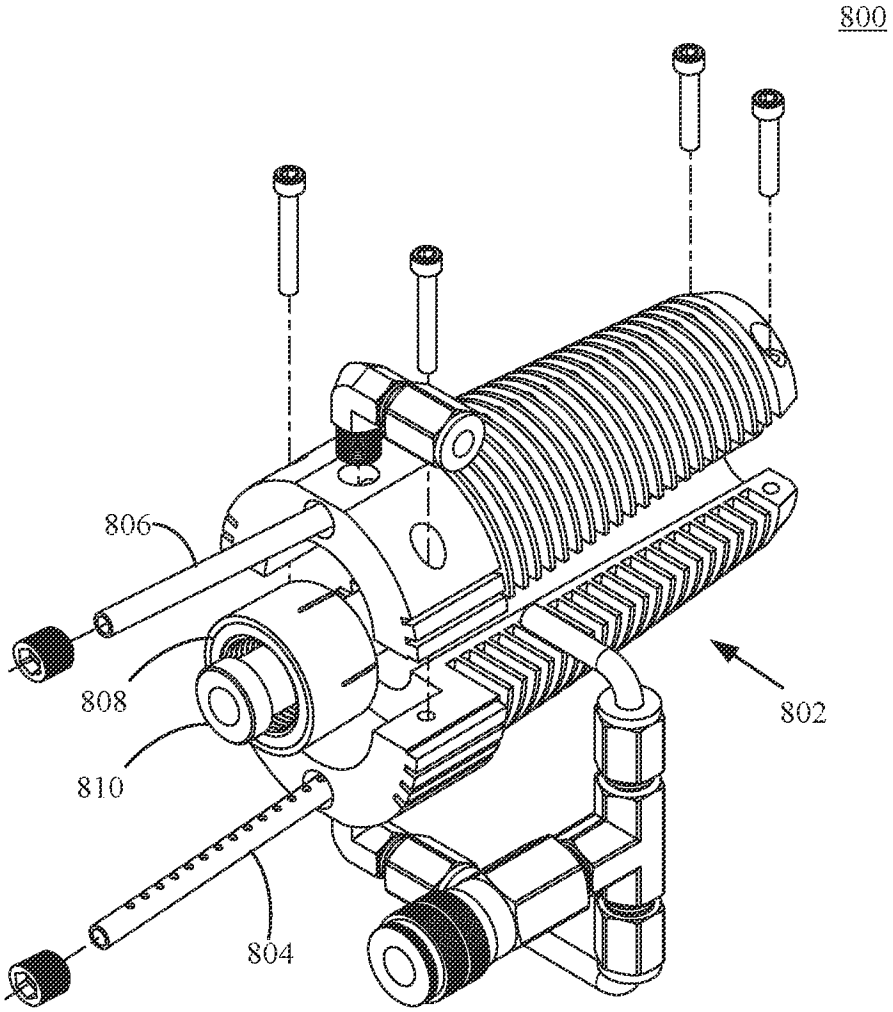
FIG. 8 depicts an exploded view of a cooling system with cooling tubes, according to an embodiment.

FIG. 8 depicts an exploded view of a cooling system 800 with cooling tubes, according to an embodiment. As shown in FIG. 8, system 800 includes cooling tube 804 and cooling tube 806 that may be inserted into channels in sleeve 802 to enable an implementation of cooling via forced convection in addition to radiative cooling. As also shown in FIG. 8, retaining nut 808 may be utilized to secure nozzle/barrel 810 to a cold spray/thermal spray system.

Figure 9:
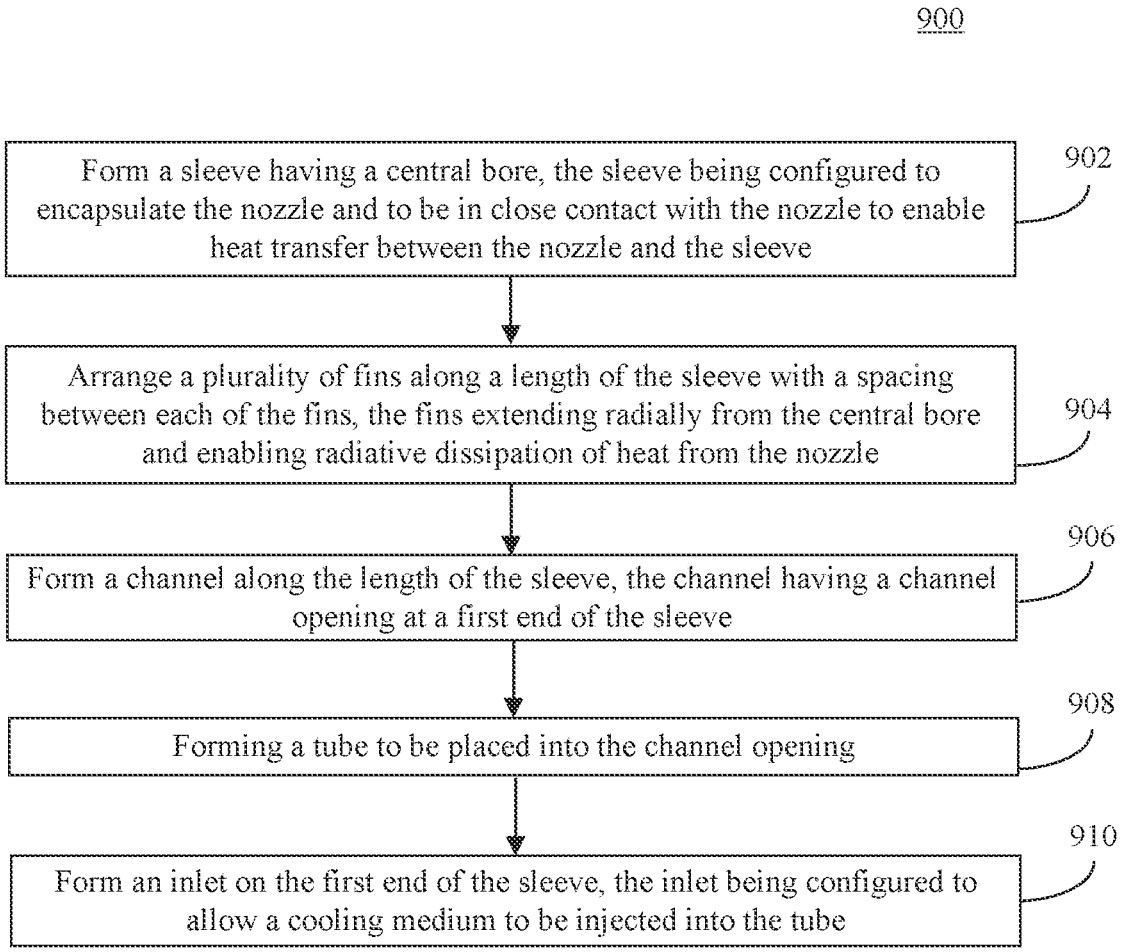
FIG. 9 depicts a flowchart for a method for fabricating a cooling system for a nozzle or a barrel, according to an example embodiment.

FIG. 9 depicts a flowchart 900 for a method for fabricating a cooling system for a nozzle or barrel, according to an example embodiment. Flowchart 900 may be implemented to fabricate any embodiment of the cooling system described herein. In embodiments, flowchart 900 may be implemented with more or fewer steps than shown in FIG. 9. Additionally, each step may be implemented by any suitable fabrication process, such as machining or additive manufacturing.

Flowchart 900 begins with step 902, a sleeve having a central bore is formed, the sleeve being configured to encapsulate the nozzle/barrel and to be in close contact with the nozzle/barrel to enable heat transfer between the nozzle/barrel and the sleeve. For example, the sleeve may be formed as depicted in FIGS. 2-5 and 8 and described above. In embodiments, a conductive paste or similar may be utilized to ensure and/or enhance the close contact and heat transfer between the nozzle/barrel and the sleeve. The sleeve may be formed of one or more sections. In embodiments, the sleeve may be formed to include a plurality of sections that are secured together via a removable securing means. In embodiments, the sleeve may be utilized for a thermal spray process. In other embodiments, the sleeve may be utilized for a cold spray process.

In step 904, a plurality of fins is arranged along a length of the sleeve with a spacing between each of the fins, the fins extending radially from the central bore and enabling radiative dissipation of heat from the nozzle/barrel. For example, the fins may be arranged along the length of the sleeve and extending radially from the central bore of the sleeve to enable radiative dissipation of heat from the nozzle/barrel as depicted in FIGS. 2-5 and 8 and described above. The fins may be formed by varying a diameter of each of the plurality of fins, with a first fin at the first end having a largest diameter, and a last fin at a second end having a smallest diameter.

In step 906, a channel is formed along the length of the sleeve, the channel having a channel opening at a first end of the sleeve. For example, the channel may be formed as shown in FIGS. 2-5 and 8 and described above. In embodiments, the channel may be formed to be open at the inlet end of the sleeve and to be closed at the outlet end of the sleeve.

In step 908, forming a tube to be placed into the channel opening. For example, a cooling tube may be formed as shown in FIGS. 6 and 7 and described above. The cooling tube may be formed with a plurality of perforations along a length of the cooling tube, each of the perforations being configured to be aligned with the spacing between each of the fins to enable the cooling medium to flow across the fins. The perforations may be formed having the same or different sizes. For example, a first perforation closest to the inlet may have the smallest size, and a last perforation farthest from the inlet may have the largest size.

In step 910, an inlet is formed on the first end of the sleeve, the inlet being configured to allow a cooling medium to be injected into the tube. In embodiments, the inlet may be formed on the inlet end of the sleeve to allow a cooling medium to be injected into the cooling tube, as depicted in FIGS. 3, 4 and 8 and described above. The cooling medium may include at least one of a compressed gas or a liquid.

In an embodiment, flowchart 900 may include further steps of forming another channel along the length of the sleeve, and forming another tube to be placed into that channel. In another embodiment, as many channels and cooling tubes may be formed while accounting for spacing in the sleeve as well as the arrangement of the associated fittings such that the spraying operation is not obstructed or hindered.

Additional Embodiment

Figure 10:
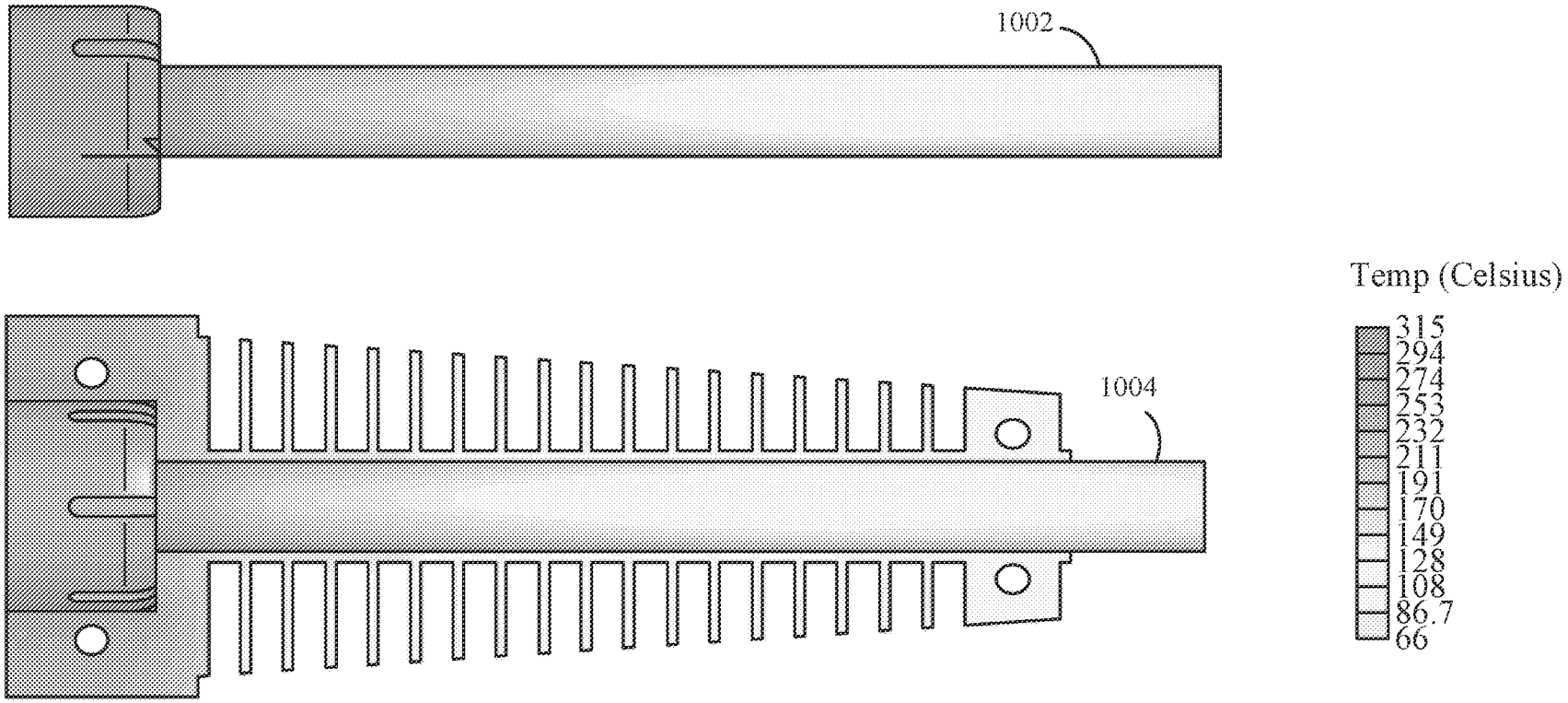
FIG. 10 depicts temperature data acquired during testing of a nozzle of a cold spray process in comparison with and without a cooling system.

An embodiment of the cooling system described herein has been tested with a cold spray process and the resulting data indicate the cooling potential of the cooling fins as shown in Table 1 below and in FIG. 10. FIG. 10 depicts temperature data acquired for a nozzle without and with a cooling system described herein. The cooling system was fabricated from 6061 aluminum and encapsulated the nozzle exterior for more efficient heat conduction. Low pressure compressed air was supplied through the cooling system and allowed for increased heat removal. The differences in nozzle temperature with and without the cooling system were measured across multiple locations and shown as a temperature gradient model in FIG. 10.

During actual operation, temperatures were measured from the retaining nut (start of the nozzle at the inlet end) to the exposed nozzle tip (outlet end).

TABLE 1

Temperature gradient profile of a nozzle with and without a cooling system

| Material | Retaining Nut Temperature | Nut to Throat Temperature (e.g., convergence shown in FIG. 1) | End of Throat to Exit (e.g., divergence shown in FIG. 1) |
|---|---|---|---|
| Nozzle 1002 | 260° C. | 260° C. reduced to 225° C. | 193° C. to 80° C. |
| Nozzle 1004 | 260° C. | 260° C. reduced to 180° C. | 177° C. to 60° C. |

As shown in FIG. 10 and Table 1 above, nozzle 1004 (with the cooling system described herein) provides a greater reduction in temperatures than nozzle 1002 (without any cooling system). The cooling system increased the conduction surface for additional heat removal via radiation and forced convection, and in turn, provided enough nozzle temperature reduction to help slow down particle buildup and extend the nozzle service life by an additional two times.

CONCLUSION

While various embodiments of the disclosed subject matter have been described above, it should be understood that they have been presented by way of example only, and not limitation. Various modifications and variations are possible without departing from the spirit and scope of the embodiments as defined in the appended claims. Accordingly, the breadth and scope of the disclosed subject matter should not be limited by any of the above-described exemplary embodiments, but should be defined only in accordance with the following claims and their equivalents.

What is claimed is:

1. A cooling system for a nozzle or a barrel, comprising:

a sleeve having a central bore, the sleeve being removably secured in direct contact with the nozzle or the barrel to enable heat transfer between the nozzle or the barrel and the sleeve;

a plurality of fins disposed along a length of an exterior surface of the sleeve with a spacing between each of the fins, the fins extending radially around the central bore and enabling radiative dissipation of heat from the nozzle or the barrel;

a channel formed inside of the sleeve along the length of the sleeve, the channel having a channel opening at a first end of the sleeve;

a tube configured to be placed into the channel via the opening, wherein the tube comprises a plurality of perforations along a length of the tube, each of the perforations being configured to be aligned with a respective spacing of the spacings between the fins to enable a cooling medium to be ejected from the tube to flow across the fins; and an inlet formed on the first end of the sleeve, the inlet being configured to allow the cooling medium to be injected into the tube.

2. The system of claim 1, wherein the sleeve comprises a plurality of sections that are secured together via a removable securing means.

3. The system of claim 1, wherein the fins have varying diameters, with a first fin at the first end having a largest diameter, and a last fin at a second end having a smallest diameter.

4. The system of claim 1, wherein the perforations have different sizes, with a first perforation closest to the inlet having a smallest size, and a last perforation farthest from the inlet having a largest size.

5. The system of claim 1, wherein the cooling medium comprises at least one of a compressed gas or a liquid.

6. The system of claim 1, further comprising:

another channel formed along the length of the sleeve; and another tube configured to be placed into the another channel.

7. A method for fabricating a cooling system for a nozzle or a barrel according to claim 1, the method comprising:

forming the sleeve having the central bore;

arranging the plurality of fins along the length of the sleeve;

forming the channel along the length of the sleeve;

forming the tube to be placed into the channel opening; and forming the inlet on the first end of the sleeve.

8. The method of claim 7, wherein the sleeve comprises a plurality of sections that are secured together via a removable securing means.

9. The method of claim 7, further comprising:

varying a diameter of each of the plurality of fins, with a first fin at the first end having a largest diameter, and a last fin at a second end having a smallest diameter.

10. The method of claim 7, further comprising:

forming the plurality of perforations along the length of the tube.

11. The method of claim 10, wherein the perforations having different sizes, with a first perforation closest to the inlet having a smallest size, and a last perforation farthest from the inlet having a largest size.

12. The method of claim 7, wherein the cooling medium comprises at least one of a compressed gas or a liquid.

13. The method of claim 7, further comprising:

forming another channel along the length of the sleeve; and forming another tube to be placed into the another channel.

* * * * *